United States Patent [19]

Jayne

[11] 3,990,761

[45] Nov. 9, 1976

[54] ZERO FORCE CONNECTOR ASSEMBLY

[75] Inventor: Max Leroy Jayne, North Warren, Pa.

[73] Assignee: GTE Sylvania Incorporated, Stamford, Conn.

[22] Filed: Aug. 11, 1975

[21] Appl. No.: 603,727

[52] U.S. Cl. ..... 339/74 R

[51] Int. Cl.[2] ..... H01R 13/62

[58] Field of Search ..... 339/74, 75, 176

[56] References Cited

UNITED STATES PATENTS

| | | | |
|---|---|---|---|
| 3,158,421 | 11/1964 | Hasenauer, Jr. | 339/176 MF |
| 3,710,303 | 1/1973 | Gallager, Jr. | 339/74 R |
| 3,818,419 | 6/1974 | Crane | 339/74 R |
| 3,899,234 | 8/1975 | Yeager et al. | 339/74 R |
| 3,922,054 | 11/1975 | Dichelette | 339/176 MF |

*Primary Examiner*—Joseph H. McGlynn
*Attorney, Agent, or Firm*—Norman J. O'Malley; Lawrence R. Fraley; Donald R. Castle

[57] ABSTRACT

An electrical connector assembly for providing zero force against a printed circuit board during positioning or removal of the board within the connector. The assembly includes a resilient electrically insulative means for engaging each of the contacting portions of the contacts positioned within the connector's housing. An actuating means is employed to engage said electrically insulative means prior to insertion and removal of the circuit board to provide a progressive removal of the contacting portions of the contacts from within the housing's slot.

10 Claims, 8 Drawing Figures

Fig. 1
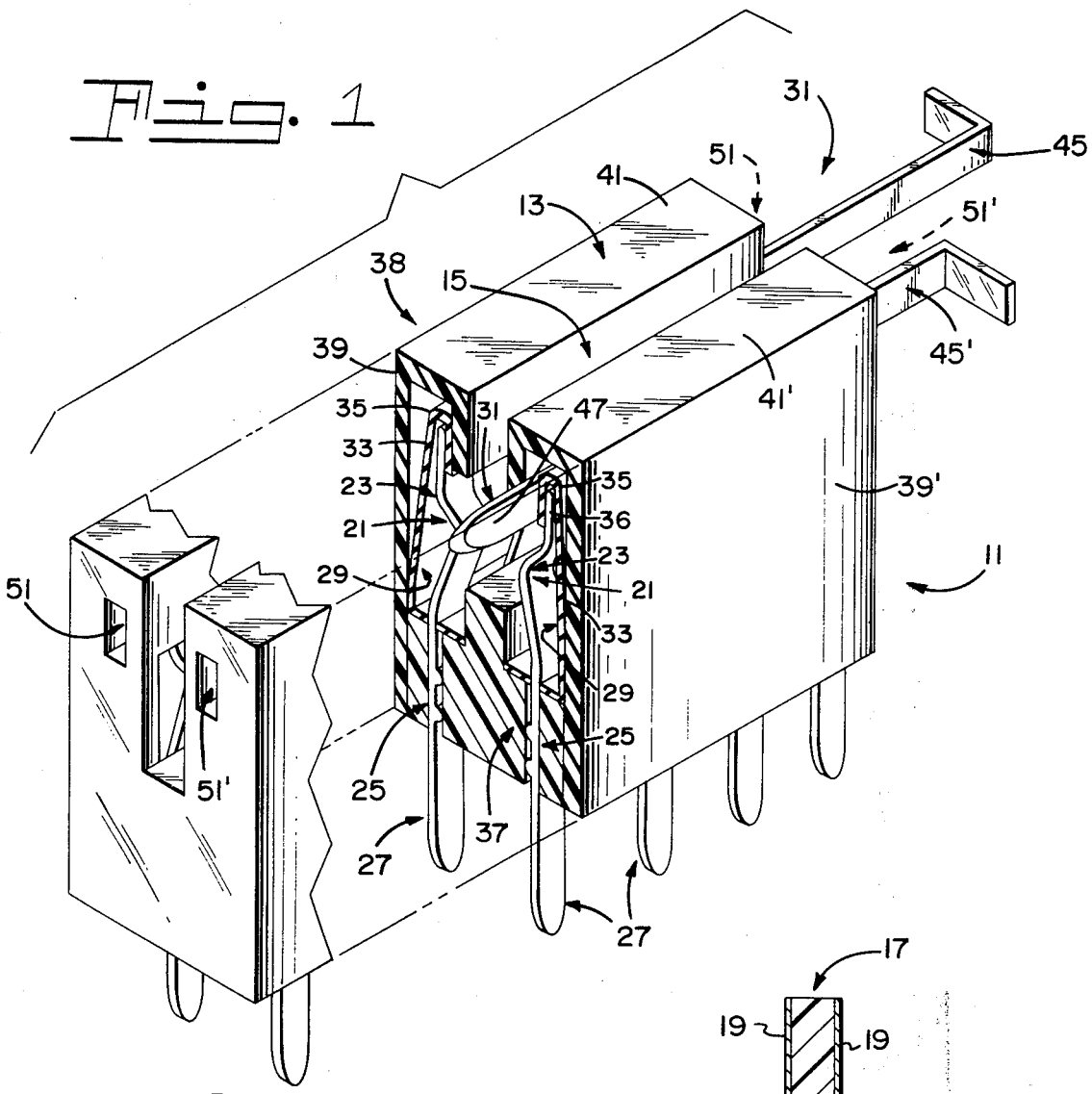
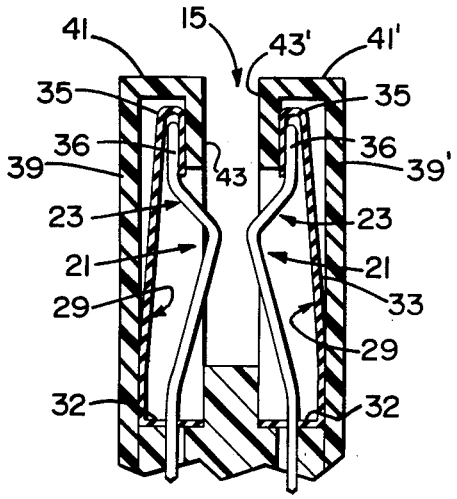
Fig. 2
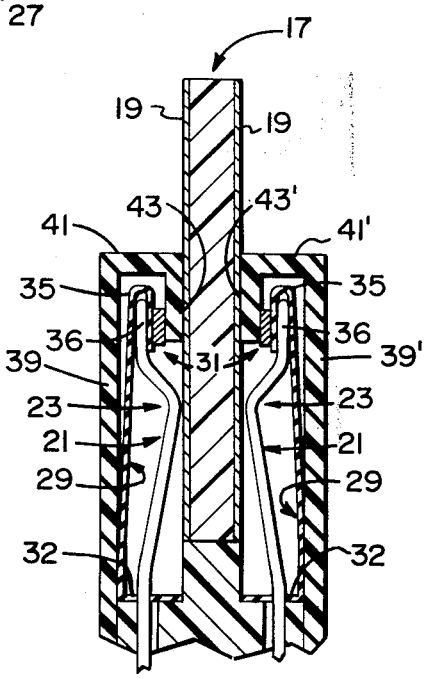
Fig. 3

ZERO FORCE CONNECTOR ASSEMBLY

BACKGROUND OF THE INVENTION

The invention relates to electrical connectors and more particlarly to electrical connectors for printed circuit boards wherein substantially zero force is applied against the board during insertion and removal of the board from the connector.

Zero force connectors are well known in the art and incorporate such components as rotatable cams, segmented housings and a variety of similar members to satisfactorily remove the contacts from within the connector housing's receiving slot. These members usually comprise an integral part of the connector which in turn necessitates a relatively complex molding operation for both housing and component. With particular regard to rotatable cam embodiments, it is required not only to design the housing to seat this member but also to properly retain the member during operation. Concerning segmented housings which usually interact to remove the contacts from a force exerting position, it is also necessary to provide a relatively complicated design for said components in order to provide their satisfactory functioning. A typical example of such a connector is shown in U.S. Pat. No. 3,818,419 wherein Crane requires not only utilization of undulant springs but also a pair of cooperating guide members. To provide zero force, Crane requires engagement of the guides which in turn engage the contacts. The undulant springs are required to assure return of the moved guides. As can be appreciated, such a design is extremely complicated and requires several components, thus necessitating substantial manufacturing costs.

Accordingly, it is believed that a printed circuit board connector which will provide zero insertion and removal forces against the circuit board in addition to requiring only a minimum number of components would constitute an advancement in the art.

OBJECTS AND SUMMARY OF THE INVENTION

It is therefore a primary objective of the present invention to enhance the electrical connector art.

It is another objective of the present invention to provide a zero force connector which would obviate the above-cited disadvantages of prior art connectors.

It is a still further objective of the present invention to provide a zero force connector which will operate in a facile and efficient manner.

In accordance with one aspect of the present invention, there is provided a connector assembly comprising a housing, a plurality of contacts positioned within the housing in aligned relationship, a resilient electrically insulative means, and an actuating means. The resilient electrically insulative means is positioned within the connector's housing in engaged relationship with each of the contacting portions of the contact members. An actuating means is employed to engage said electrically insulative means to progressively remove the contacting portions of the contacts from within the housing's slot in order to provide zero insertion force against a printed circuit board.

BRIEF DESCRIPTION OF THE DRAWINGS

FIG. 1 is an isometric view of the connector assembly in accordance with a preferred embodiment of the present invention;

FIG. 2 is a side elevational view, partly in section, illustrating the positioning relationship of the contacts and resilient electrically insulative means of the present invention;

FIG. 3 is a side elevational view, partly in section, illustrating the positioning relationship of the connector's actuating means during engagement with the insulative means;

DETAILED DESCRIPTION OF THE PREFERRED EMBODIMENTS

Figure 5:
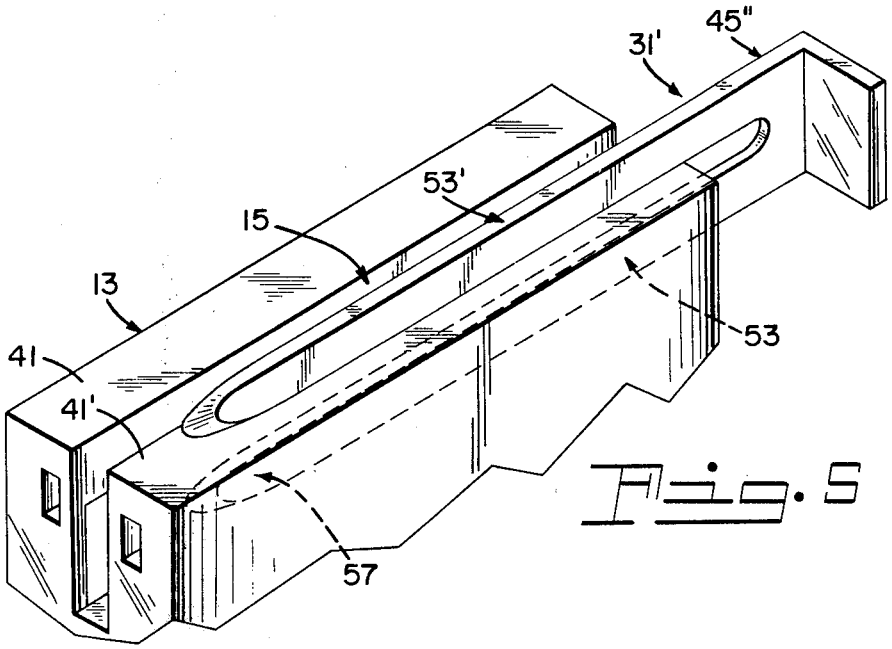
FIG. 5 represents an alternate embodiment of an actuating means suitable for use in the present invention.

For a better understanding of the present invention, together with other and further objects, advantages and capabilities thereof, reference is made to the following specification and appended claims in connection with the above-described drawings.

With particular reference to FIG. 1, there is shown an isometric view of a connector assembly 11 in accordance with a preferred embodiment of the present invention. Assembly 11 comprises a housing 13 including a slot 15 therein for receiving a printed circuit board 17 (shown in FIG. 3) having a plurality of electrically conductive areas 19 thereon. Assembly 11 further includes a plurality of contacts 21 positioned within housing 13 in aligned relationship and each including a contacting portion 23, a substantially centrally located retaining portion 25 retained within housing 13, and a tail portion 27 extending from housing 13.

The connector assembly 11 also comprises a resilient electrically insulative means 29 positioned within housing 13 in engaged relationship with each of the contacting portions 23 and an actuating means 31 for engaging said insulative means 29.

As illustrated in FIG. 2, each of the contacting portions 23 of contacts 21 are at least partially positioned within slot 15 for engaging the electrically conductive areas 19 of circuit board 17 when inserted therein. As illustrated, the configuration of the contacting portions 23 in addition to the described positioning relationship provides a means whereby the contacts exert an established contacting force against conducting areas 19. This is only desirable however when the circuit board is positioned within connector assembly 11. It is not desired to exert this force during insertion and removal of circuit board 17 for reasons well known in the art. For example, relatively high forces applied against the circuit board tend to have a deleterious effect on the conductive areas 19 during insertion and removal if the contacting portions 23 remain in the position indicated in FIG. 2. Further, this also results in possible damage to the contacting portions of the contacts which engage the conductive areas 19. In the present connector art, it is well known to include on these contacting portions a relatively thin portion of a precious metal such as gold. As can be appreciated, excessive forces exerted against this precious material by a wiping of similar movement may tend to remove said material from the illustrated contacting portions.

Accordingly, it is a primary objective of connector assembly 11 to provide zero force against printed circuit board 17 during insertion and removal of the board from within slot 15 of the assembly. This is achieved in one aspect of the invention by providing an actuating means 31 which, when positioned within housing 13, engages the resilient electrically insulative means 29 to progressively remove contacting portions 23 from within slot 15. The resulting position of contacting portions 29 after said progressive removal is illustrated in FIG. 3. Once the circuit board 17 has been satisfactorily positioned within slot 15, the described actuating means 31 is removed from housing 13 and the contacting portions 23 exert the previously described contacting force against areas 19.

Figure 4:
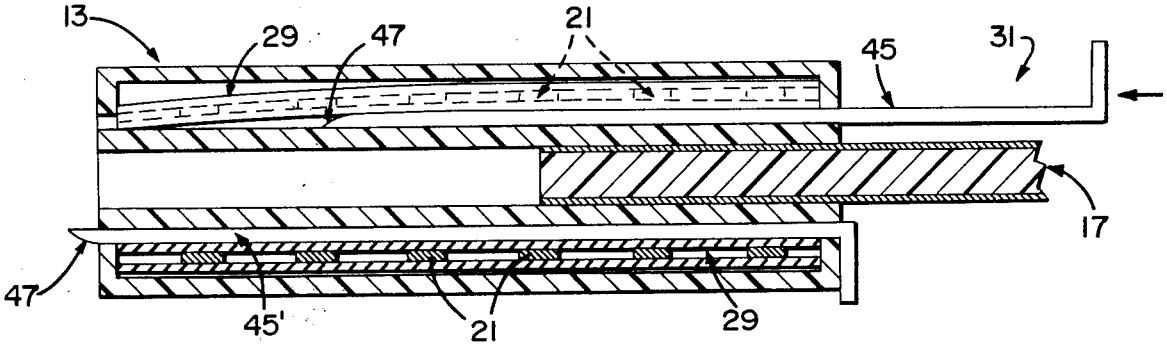
FIG. 4 is a top view, partly in section, illustrating the relative positioning of the invention's actuating means within the connector's housing.

As further illustrated in the drawings, electrically insulative means 29 comprises a substantially solid member which includes a base portion 32, an intermediate portion 33, and an angular head portion 35. Base portion 32 is positively seated within housing 13. Additionally, the angular head portion 35 substantially surrounds a non-engaging end portion 36 of each of the contacting portions 23 of contacts 21. As clearly shown in FIGS. 2 and 3, end portions 36 of contacting portions 23 do not physically engage the circuit board 17. Intermediate portion 33 serves to interconnect angular head portion 35 and base portion 32. In the preferred embodiment of the invention, the substantially solid member 29 serves to surround all of the end portions 36 of the contacts as positioned along a singular row within housing 13. In connector assemblies including two opposing rows of contacts 21 as indicated in the drawings, two separate insulative means 29 are required. An added view of the described solid insulative means 29 as positioned about the contacting portions 23 is shown in FIG. 4.

Housing 13 preferably comprises a base portion 37, an upper portion 38 including a pair of opposingly positioned upstanding walls 39 and 39' and a corresponding pair of top portions 41 and 41'. As illustrated in FIG.1, slot 15 is positioned substantially between top portions 41 and 41' and the described upstanding sides 39 and 39' of upper portion 38. As also shown in FIG. 1, connector assembly 11 is adapted for receiving printed circuit boards from both a side entry as well as insertion from the top. When only a side entry is desired, however, it is understood that housing 13 can be provided with a stop or similar portion which would extend across slot 15 at one end of the housing. Such a member would serve to define the amount of entry of a circuit board as well as assure alignment of conductive portions of the board with the corresponding contacts. Because such a stop member does not constitute a significant feature of the invention, it is not illustrated in the drawings.

Housing 13 is also illustrated in the drawings as comprising retention means 43 and 43' which extend downwardly from the described top portions 41 and 41' respectively. Each of these retention means are positively engaged by the illustrated resilient electrically insulative means 29 to therefore define the positioning relationship of the contacting portions 23 within housing 13 during the absence of circuit board 17. Retention means 43 and 43' preferably comprise a pair of longitudinal walls which extend downwardly from top portions 41 and 41' respectively to thus form an upper retaining portion for angular head portions 35 of insulative means 29. As is understood, the connector assembly of the present invention can function without requiring the aforementioned retention means 43 and 43'. That is, the connector assembly in its simplest form can include only base portion 37 as the housing member and have therein the illustrated rows of contacts 21. As will be understood with further description, removal of the contacting portions 23 may then be achieved by utilization of an alternate embodiment of an actuating means such as that illustrated in FIG. 6. Accordingly, utilization of this member will not require a retention means such as 43 and 43' as well as portions 39, 39', 41 and 41' of upper portion 38. It is to be understood however that the concept illustrated in FIG. 6 is also adaptable to the housing assemblies illustrated in FIGS. 1–5.

In FIG. 3 is shown the preferred positioning relationships of actuating means 31 within connector assembly 11. As illustrated, actuating means 31 engages the described resilient electrically insulative means 29 to remove contacting portions 23 from within slot 15. Furthermore, FIG. 3 shows the subsequent positioning relationship of printed circuit board 17 once this progressive removal has been achieved. As also illustrated in FIG. 3, actuating means 31 further engages the aforementioned retention means 43 and 43' during said progressive removal. Actuation means 31 is adapted for moving between retention means 43 and 43' and the surrounding angular head portions 35 of insulative means 29 to provide removal of both rows of contacts.

Actuation means 31 in the preferred embodiment of the invention comprises a pair of elongated bar members 45 and 45'. Two such bar members are illustrated in FIG. 1 due to the positioning of two separate and opposing rows of contacts. Only one bar need be utilized should only one row of contacts 21 be desired within housing 13. In the preferred embodiment of the invention, each elongated bar member includes a pointed end portion 47 which is particularly adapted for engaging the resilient insulating means 29 to provide the described removal. The utilization of pointed end portions 47 is particularly desired to facilitate separation of the assembly's retention means and the corresponding angular head portions 35 of insulative means 29.

To accommodate bars 45 and 45', housing 13 is provided with a pair of corresponding openings 51 and 51'. Openings 51 and 51' are provided within each of the opposing ends of housing 13. Should it only be desirable to utilize one bar in connector assembly 11, it would therefore only be necessary to provide a singular opening at each opposing end of housing 13 to accommodate said bar member. However, when utilizing two opposingly positioned rows of contacts, it is necessary to use the openings as illustrated.

In FIG. 4 there is shown the partial positioning of bar member 45 within housing 13. Also illustrated is the complete positioning of second bar 45' within housing 13. It can be seen that during insertion of the actuating bar members within connector housing 13, a progressive removal of the connectors contacting portions from within slot 15 is provided. As previously mentioned, this progressive removal is the result of incorporation of the surrounding resilient electrically insulative means 29. Accordingly, means 29 is angularly displaced with respect to the direction of insertion of the corresponding bar member 45. This angular displacement assures the described and desired progressive removal of the contacts surrounded and engaged by the angular head portion 35 of means 29.

Figure 6:
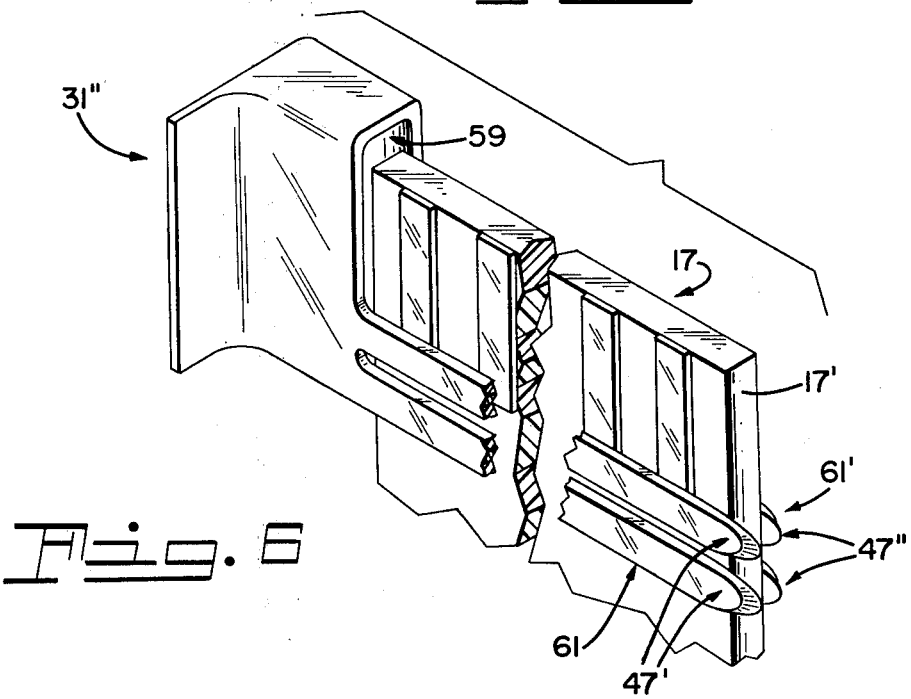
FIG. 6 represents still another embodiment of an actuating means for use with the present invention.

FIG. 5 represents an alternate embodiment of an actuating means for use with the connector assembly of the present invention. Actuating means 31' comprises an elongated bar member 45'' which includes first and second extending portions 53 and 53'. The first extending portion 53 includes a pointed end portion 57 substantially similar to pointed end portions 47 of bar members 45 and 45' in FIG. 1. Also similar to pointed end portions 47, pointed end portion 57 of extending portion 53 is adapted for engaging the resilient electrically insulative means 29 located within housing 13 to provide the previously described progressive removal of the contacting portions 23 from within slot 15. As stated, actuating means 31' further includes a second extending portion 53' positioned relative to first extending portion 53 in substantially parallel alignment and adapted for engaging the top portion 41 (or 41') of housing 13 to thereby assure alignment of first extending portion 53 within housing 13. That is, second extending portion 53' slidably engages the top portion of housing 13 and assures the relative positioning of first portion 53 during first portion 53's entry within the housing. It can also be seen that the dual portioned actuating means 31' of FIG. 5 is adapted for being inverted and then positioned within housing 13. This provides an added feature of versatility to assembly 11 when utilizing actuating member 31'.

In FIG. 6 there is illustrated still another embodiment of an actuating means for use in assembly 11. In the embodiment of FIG. 6, actuating means 31'' is formed in such a manner that it may be readily positioned on circuit board 17 prior to insertion of the board within connector 11. This is achieved in the manner indicated by providing actuating means 31'' with a spacing member 59 which is easily positioned on board 17. Spacing member 59 can also form an integral portion of board 17 if desired. Accordingly, each of the formed extending portions (61 and 61') of the actuating means forms an integral part with this member in the manner illustrated. As can be seen in FIG. 6, the actuating means can be positioned on the board at any location, it only being essential that the pointed end portions 47' and 47'' of means 31'' extend beyond (or before) the leading edge 17' of circuit board 17 during its insertion into the connector housing.

Figure 7:
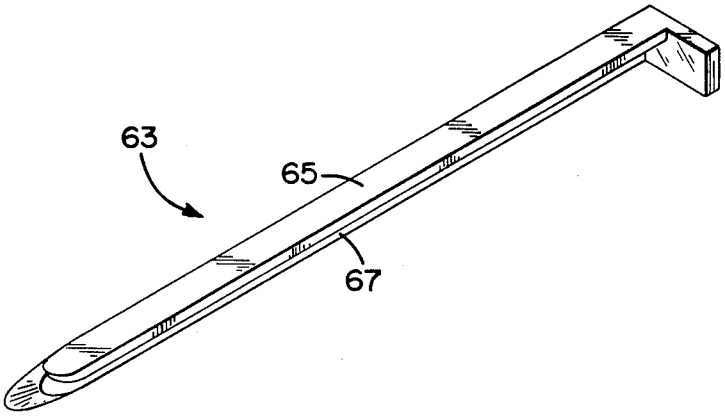
FIG. 7 is an isometric view of another embodiment of an actuating means.
Figure 8:
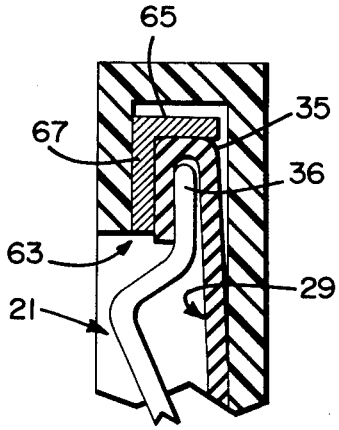
FIG. 8 is a side elevational view, partly in section, showing the actuating means of FIG. 7 positioned within an insulative housing.

FIGS. 7 and 8 represent still another embodiment of an actuating means 63 suitable for use in the present invention. Means 63 is angular in cross-section having a first side 65 and a second side 67. Side 67 is substantially similar to portion 47 of bar members 45 and 45' in FIG. 1. Adjoining side 65 is added to provide alignment capabilities to means 63. This is achieved by side 65 slidably engaging a corresponding opening in the connector housing's upper portion, said opening being substantially similar but somewhat larger than the cross-sectional configuration of means 63. This alignment will further substantially eliminate the possibility of means 63 from lowering itself during insertion and electrically shorting contacts 21 during assembly operation. As can be appreciated, the above-described embodiment is particularly adaptable to connector assemblies wherein the housings are of substantial length.

It is preferred to utilize stainless steel or similar material for each of the described actuating bar members of the present invention. It is also preferred to utilize either mylar or a relatively thin fish paper for the resilient electrically insulative means 29 of the present invention. As can be understood, the housing is preferably of an electrically insulative material such as plastic while the contacts are preferably of phosphor bronze or similar material. It is to be understood however that several materials having similar properties to those described could be readily substituted for those shown.

Thus there has been shown and described an electrical connector for providing zero force against a printed circuit board during insertion and removal of the board. This zero force is achieved by the provision of an actuating means which is inserted into the connector housing prior to insertion or removal of the board. The actuating means as shown and described serves to engage a resilient electrically insulative means within the housing to progressively remove the contacting portions of the contacts from within the connector housing's receiving slot. Once insertion has been achieved, the described actuating means are removed from the connector housing and a satisfactory contacting force is thereafter exerted against the electrically conducting areas on the circuit board. The connector assembly as defined by the present invention provides for progressive removal of said contacting portions to thereby facilitate insertion of said actuating means within the housing thus overcoming a significantly greater instantaneous force which would result if said progressive removal were not employed. As also described, the connector assembly of the present invention provides for a minimum number of components while still providing the features described.

While there has been shown and described what are at present considered the preferred embodiments of the invention, it will be obvious to those skilled in the art that various changes and modifications may be made therein without departing from the scope of the invention as defined by the appended claims.

What is claimed is:

1. A connector assembly comprising:

a housing including a slot therein for receiving a printed circuit board having a plurality of electrically conductive areas thereon;

a plurality of contacts positioned within said housing in aligned relationship, each of said contacts including a contacting portion at least partially positioned within said slot for engaging one of said electrically conductive areas on said printed circuit board when said board is positioned within said slot, a substantially centrally located retaining portion positively retained within said housing, and a tail portion extending from said housing, each of said contacting portions of said contacts including an end portion thereon, said end portion not engaging said circuit board;

resilient electrically insulative means positioned within said housing, said insulative means including a base portion positively seated within said housing, an intermediate portion, and an angular head portion substantially surrounding each of said end portions of said contacting portions of said contacts; and actuating means comprising a substantially elongated bar for engaging said angular head portion of said resilient electrically insulative means to progressively remove said contacting portions of said contacts from within said slot prior to insertion and removal of said circuit board within said slot.

2. The connector assembly according to claim 1 wherein said resilient electrically insulative means comprises a substantially solid member.

3. The connector assembly according to claim 1 wherein said elongated bar member includes a pointed end portion for engaging said resilient electrically insulative means to provide said progressive removal of said contacting portions from within said slot.

4. The connector assembly according to claim 1 wherein said housing includes an opening therein for receiving said substantially elongated bar member.

5. The connector assembly according to claim 1 wherein said elongated bar member is substantially angular in cross-section.

6. The connector assembly according to claim 1 wherein said housing further includes retention means for positively engaging said angular head portion of said resilient electrically insulative means to define the positioning relationship of said contacting portions of said contacts within said slot.

7. The connector assembly according to claim 6 wherein said actuating means further engages said retention means of said housing during said progressive removal of said contacting portions of said contacts from within said slot.

8. The connector assembly according to claim 1 wherein said elongated bar member includes first and second extending portions, said first extending portion including a pointed end portion for engaging said resilient electrically insulative means to provide said progressive removal of said contacting portions from within said slot, said second extending portion positioned relative to said first extending portion for engaging said housing to provide alignment of said first extending portion during said engagement with said resilient electrically insulative means.

9. The connector assembly according to claim 8 wherein said housing includes an opening therein for receiving said first extending portion of said elongated bar member.

10. The connector assembly according to claim 8 wherein said second extending portion is positioned substantially parallel to said first extending portion.

* * * * *